US007633279B2

(12) United States Patent
Asaoka et al.

(10) Patent No.: US 7,633,279 B2
(45) Date of Patent: Dec. 15, 2009

(54) POWER SUPPLY CIRCUIT

(75) Inventors: Takashi Asaoka, Chuo-ku (JP); Akira Ide, Chuo-ku (JP)

(73) Assignee: Elpida Memory, Inc., Tokyo (JP)

( * ) Notice: Subject to any disclaimer, the term of this patent is extended or adjusted under 35 U.S.C. 154(b) by 73 days.

(21) Appl. No.: 11/365,668

(22) Filed: Mar. 2, 2006

(65) Prior Publication Data

US 2006/0197517 A1 Sep. 7, 2006

(30) Foreign Application Priority Data

Mar. 4, 2005 (JP) ..... 2005-060469

(51) Int. Cl.
*G05F 3/16* (2006.01)
*G05F 1/10* (2006.01)
*G05F 3/02* (2006.01)

(52) U.S. Cl. ..... 323/313; 323/315; 327/539

(58) Field of Classification Search ..... 323/312, 323/313, 315, 316, 907; 327/513, 538, 539, 327/540, 541, 543
See application file for complete search history.

(56) References Cited

U.S. PATENT DOCUMENTS 4,645,948 A * 2/1987 Morris et al. ..... 327/538
5,384,740 A * 1/1995 Etoh et al. ..... 365/189.09
5,467,052 A * 11/1995 Tsukada ..... 327/543
6,392,392 B1 * 5/2002 Nakahara ..... 323/312
7,071,673 B2 * 7/2006 Menegoli et al. ..... 323/315
2004/0207380 A1 * 10/2004 Ariki ..... 323/313

FOREIGN PATENT DOCUMENTS

| | | | |
|---|---|---|---|
| JP | 62-500327 | A | 2/1987 |
| JP | 62-28089 | U | 7/1987 |
| JP | 2-48926 | A | 10/1990 |
| JP | 5-191167 | A | 7/1993 |
| JP | 5-218761 | A | 8/1993 |
| JP | 5-297969 | A | 11/1993 |
| JP | 5-303438 | A | 11/1993 |
| JP | 6-242847 | A | 9/1994 |
| JP | 8-265068 | A | 10/1996 |
| JP | 9-191252 | A | 7/1997 |
| JP | 11-272345 | A | 10/1999 |
| JP | 2000-513853 | A | 10/2000 |
| JP | 2000-339962 | A | 12/2000 |
| JP | 2001-202147 | A | 7/2001 |
| JP | 2002-64374 | A | 2/2002 |
| JP | 2002-184954 | A | 6/2002 |
| JP | 2004-5048 | A | 1/2004 |
| JP | 2004-86750 | A | 3/2004 |
| JP | 2004-362335 | A | 12/2004 |

* cited by examiner

*Primary Examiner*—Edward Tso
*Assistant Examiner*—M'baye Diao
(74) *Attorney, Agent, or Firm*—Sughrue Mion, PLLC

(57) ABSTRACT

A power supply circuit is disclosed in which the influence due to variation in the characteristics of transistors is reduced by variation alleviating devices, each connected to transistors that constitute a current mirror. The power supply circuit comprises a configuration having a current mirror to produce a reference voltage. A multiple number of transistors constitute a current mirror. Multiple variation alleviating devices are connected in series with individual transistors.

9 Claims, 3 Drawing Sheets

POWER SUPPLY CIRCUIT

BACKGROUND OF THE INVENTION

1. Field of the Invention

The present invention relates to a power supply circuit having a current mirror.

2. Description of the Related Art

As a circuit for producing a reference power supply voltage, a bandgap power supply circuit having a current mirror circuit has been used (see Japanese Patent Application Laid-open 2001-202147, for example).

FIG. 1 is a schematic circuit diagram showing a configuration of a conventional bandgap power supply circuit. Referring to FIG. 1, a conventional bandgap power supply circuit includes transistors MP1 to MP3, transistors MN1 and MN2 and transistors B1 to B3 and resistances R1 and R2.

For calculation simplicity, it is assumed that transistors MP1 to MP3 are PMOS transistors of an identical size; transistors MN1 and MN2 are NMOS transistors of an identical size; transistors B1 to B3 are PNP bipolar transistors; transistor B1 and transistor B3 have an identical emitter size; and transistor B2 has an emitter size greater than transistor B1.

Transistor MP1, transistor MN1 and transistor B1 are connected in series in this order to power supply Vcc. Similarly, transistor MP2, transistor MN2, resistance R1 and transistor B2 are connected in series in this order to power supply Vcc. Further, transistor MP3, resistance R2 and transistor B3 are connected in series in this order from power supply Vcc. Transistors MP1 to MP3 constitute a current mirror portion. Output voltage BGREF is output from the node between transistor MP3 and resistance R2.

Here, currents flowing through transistors MP1, MP2 and MP3 will be denoted as I1, I2 and I3, respectively. The potential difference between both ends of resistance R1 will be denoted as ΔVBE.

Resistances R1 and R2 are set up with appropriate values so that the temperature dependence of BGREF is minimized.

Further, the base-emitter voltages of transistors B1, B2 and B3 are referred to as VBE1, VBE2 and VBE, respectively.

The conventional bandgap power supply circuit having the above configuration produces a reference power supply voltage as an output voltage when power supply Vcc is given. This output voltage BGREF is represented as Eq.(1)

$$BGREF=VBE+R2\cdot I3 \tag{1}$$

On the other hand, potential difference ΔVBE between both ends of resistance R1 is represented by Eq.(2) and current I3 flowing through transistor MP3 is represented by Eq. (3).

$$\Delta VBE=R1\cdot I2 \tag{2}$$

$$I3=I2 \tag{3}$$

Eq. (4) is obtained from Eq.(2) and Eq. (3).

$$I3=\Delta VBE/R1 \tag{4}$$

Substituting Eq. (1) into this Eq. (4) gives Eq.(5).

$$BGREF=VBE+(R2/R1)\cdot\Delta VBE \tag{5}$$

Here, if it is assumed that there is no variation in PMOS transistor characteristics and threshold voltage Vth of transistor MP2 has no offset relative to that of transistor MP1, currents I2 and I1 flowing through transistor MP1 and transistor MP2 are equal to each other, as shown in Eq. (6).

$$I2=I1 \tag{6}$$

Further, if Eq. (7) is true and when the emitter area of transistor B1 and the emitter area of transistor B2 are denoted by A1 and A2, respectively, then Eq. (8) holds, where q is the elementary charge, k is the Boltzmann constant, T is the absolute temperature of the PN junction.

$$\Delta VBE = VBE1 - VBE2 \tag{7}$$

$$I1/I2 = \frac{A1\exp(q\cdot VBE1/kT)}{A2\exp(q\cdot VBE2/kT)} \tag{8}$$

Eq. (8) can be transformed into Eq. (9).

$$VBE1-VBE2=kT/q\cdot\ln((I1/I2)\cdot(A2/A1)) \tag{9}$$

Substituting Eq. (6) and Eq. (7) in Eq. (9) produces Eq. (10).

$$\Delta VBE=kT/q\cdot\ln(A2/A1) \tag{10}$$

From Eq. (5) and Eq. (10), output voltage BGREF can be represented as $$BGREF=VBE+(R2/R1)\cdot(kT/q)\cdot\ln(A2/A1) \tag{11}$$

It is understood that VBE has a negative temperature dependence, but the temperature dependence can be cancelled out by adjusting R2/R1.

However, the prior art technology described above entails the problem as follows.

The above description was made referring to a case where threshold voltage Vth of transistor MP2 has no offset, but there are cases where some offset occurs due to variation in PMOS transistor characteristics. As a result, a shift of the output voltage from the bandgap power supply circuit takes place.

To begin with, threshold voltage Vth of transistor MP2 is presumed to have an offset of ΔVp relative to that of transistor MP1. When the threshold voltage Vth of transistor MP1 is denoted by Vp, threshold voltage Vth of transistor MP2 is given as Vp+ΔVp.

Here, when the S-parameter involving transistors MP1 and MP2 is read as S, aforementioned Eq. (6) does not hold, and the relationship between currents I2' and I1' flowing through transistors MP1 and MP2 can be given by Eq. (6') instead.

$$I2'=I1'\cdot 10^{(-\Delta Vp/S)} \tag{6'}$$

Accordingly, the aforementioned Eq. (10) is rewritten as Eq. (10').

$$\Delta VBE'=(kT/q)\cdot\{(\Delta Vp/S)\cdot\ln 10+\ln(A2/A1)\} \tag{10'}$$

According to Eq. (5), a shift ΔBGREF (=BGREF'−BGREF) arising in output voltage BGREF is given by Eq. (12).

$$\Delta BGREF=(R2/R1)\cdot(\Delta VBE'-\Delta VBE) \tag{12}$$

By inserting Eq. (10) and Eq. (10') into Eq. (12), Eq. (13) is obtained.

$$\Delta BGREF=(R2/R1)\cdot(kT/q)\cdot\ln 10\cdot(\Delta Vp/S) \tag{13}$$

Here, as a specific example where it is assumed that R2/R1=8, T=27 deg. C., S=90 mV/K are assumed, output voltage shift ΔBGREF is given as $$\Delta BGREF=5.32\cdot\Delta Vp \tag{13'}$$

which is understood to be the shift that will occur.

Next, threshold voltage Vth of transistor MP3 is presumed to have an offset of ΔVp relative to that of transistor MP2.

When the threshold voltage Vth of transistor MP2 is denoted by Vp, threshold voltage Vth of transistor MP3 is given as Vp+ΔVp.

Here, when the S-parameter involving transistors MP2 and MP3 is read as S, aforementioned Eq. (3) does not hold, and the relationship between currents I3' and I2' flowing through transistors MP2 and MP3 can be given by Eq. (3') instead.

$$I3'=I2'\cdot 10^{(-\Delta Vp/S)} \quad (3')$$

Accordingly, the aforementioned Eq. (4) is rewritten as Eq. (4').

$$I3'=(1/R1)\cdot 10^{(-\Delta Vp/S)}\cdot \Delta VBE \quad (4')$$

By inserting this Eq. (4') into Eq. (1), $$BGREF'=VBE+(R2/R1)\cdot 10^{(-\Delta Vp/S}\cdot \Delta VBE \quad (5')$$

From Eq. (5') and Eq. (5) the output voltage shift ΔBGREF is $$\Delta BGREF = BGREF' - BGREF \quad (14)$$
$$= \{10^{(-\Delta V_p/S)} - 1\}\cdot (R2/R1)\cdot \Delta VBE$$

By inserting this Eq. (14) into Eq. (10), $$\Delta BGREF=\{10^{(-\Delta Vp/S)}-1\}\cdot (R2/R1)\cdot (kT/q)\cdot \ln(A2/A1) \quad (15)$$

Here, as a specific example where it is assumed that R2/R1=8, A2/A1=8, T=27 deg. C., S=90 mV/K, output voltage shift ΔBGREF is given as $$\Delta BGREF = \{10^{(-\Delta V_p/S)} - 1\}\cdot 8\cdot (kT/q)\cdot \ln 8 \quad (15')$$
$$= \{10^{(-\Delta V_p/0.09)} - 1\}\cdot 0.43$$

which is understood to be the shift that will occur.

Next, threshold voltage Vth of transistor MN2 is presumed to have an offset of ΔVn relative to that of transistor MN1. When the threshold voltage Vth of transistor MN1 is denoted by Vn, threshold voltage Vth of transistor MN2 is given as Vn+ΔVn.

In this case, −ΔVn is added to ΔVBE in the above Eq. (5). Accordingly, the output voltage shift ΔBGREF is given as $$\Delta BGREF=-(R2/R1)\cdot \Delta Vn \quad (16)$$

Here, as a specific example where it is assumed that R2/R1=8, output voltage shift ΔBGREF is given as $$\Delta BGREF=-8\cdot \Delta Vn \quad (16')$$

which is understood to be the shift that will occur.

FIG. 2 is a graph showing the relationship between the offset of threshold voltage Vth and output voltage shift ΔBGREF in the three specific examples. In FIG. 2, the output voltage shifts ΔBGREF, given by Eq. (13'), Eq. (15') and Eq. (16'), are plotted by 91, 92 and 93, respectively. It is understood that, as an offset of about 20 mV occurs in threshold voltage Vth, output voltage BGREF will have a shift of about 300 mV max. That is, there is a possibility that an output voltage shift that is equal to ten times of, or greater than, the offset occurring in threshold voltage Vth may take place.

Further, here for calculation simplicity it was assumed that transistors MP1 to MP2, MN1 and MN2 are of an identical size and transistors B1 and B3 are of an identical size. However, in other than the above case a serious shift will similarly take place in output voltage BGREF, due to the influence of threshold voltage Vth.

As described above, in the conventional bandgap power supply circuit, there has been the problem that the output voltage is seriously affected by minute variation in device characteristics.

In the actual LSIs, variation in characteristics will take place due to anisotropy and layout pattern dependence, however, such variation to some extent is regarded to be within tolerance. However, as for the bandgap power supply circuits, it has become difficult to operate the current mirror portion in saturated range as LSIs developed into low-voltage configurations. As a result, some level of minute variation which can be permitted in usual circuits may cause a serious output voltage shift in a bandgap power supply circuit, which cannot be permitted.

SUMMARY OF THE INVENTION

The object of the present invention is to provide a power supply circuit in which influence on the output voltage due to variation in device characteristics can be reduced.

In order to attain the above object, the power supply circuit of the present invention is a power supply circuit for producing a reference voltage, and includes a plurality of MOS transistors and a plurality of variation alleviating devices. The multiple MOS transistors constitute a current mirror to produce a reference voltage. The multiple variation alleviating devices are connected in series with the individual transistors.

According to the present invention, since a plurality of transistors that constitute a current mirror are connected in series with variation alleviating devices for reducing the influence of variation in the characteristics of the transistors, it is possible to reduce the influence on the output voltage due to variation in device characteristics.

The above and other objects, features, and advantages of the present invention will become apparent from the following description with references to the accompanying drawings which illustrate examples of the present invention.

DETAILED DESCRIPTION OF THE PREFERRED EMBODIMENTS

Figure 1:
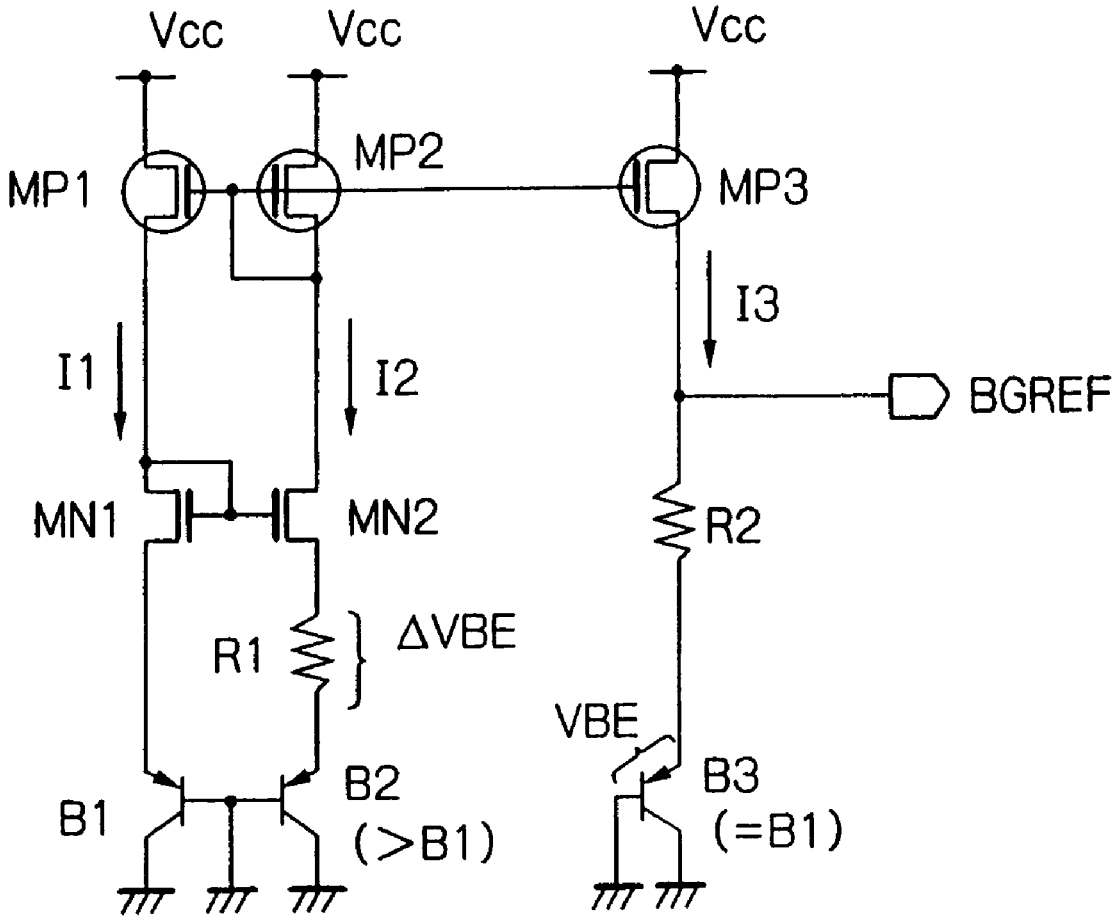
FIG. 1 (RELATED ART)
FIG. 1 is a schematic circuit diagram showing a configuration of a conventional bandgap power supply circuit.
Figure 2:
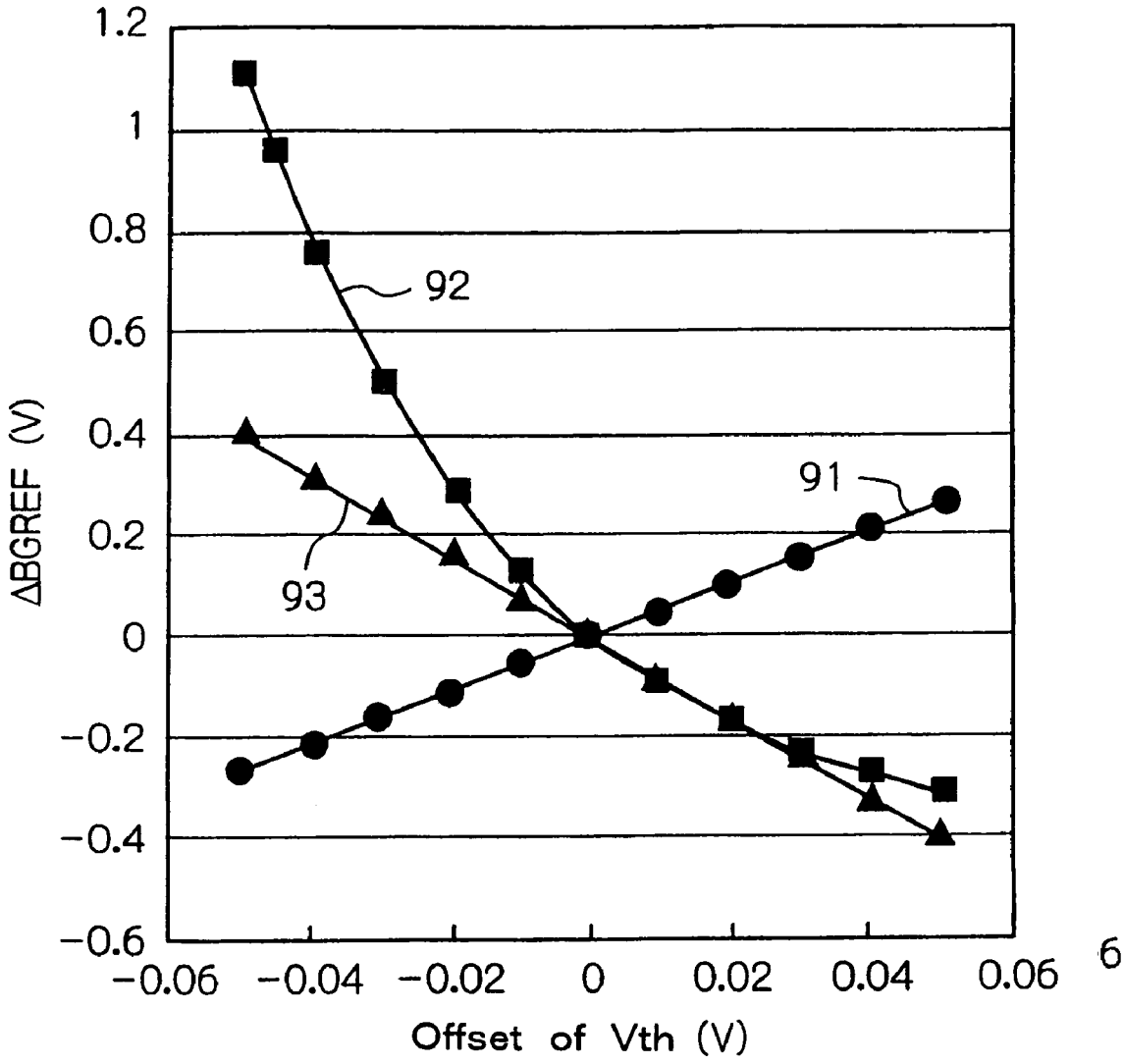
FIG. 2 (RELATED ART)
FIG. 2 is a graph showing the relationship between the offset of the threshold voltage Vth and the output voltage shift ΔBGREF in three specific examples.
Figure 3:
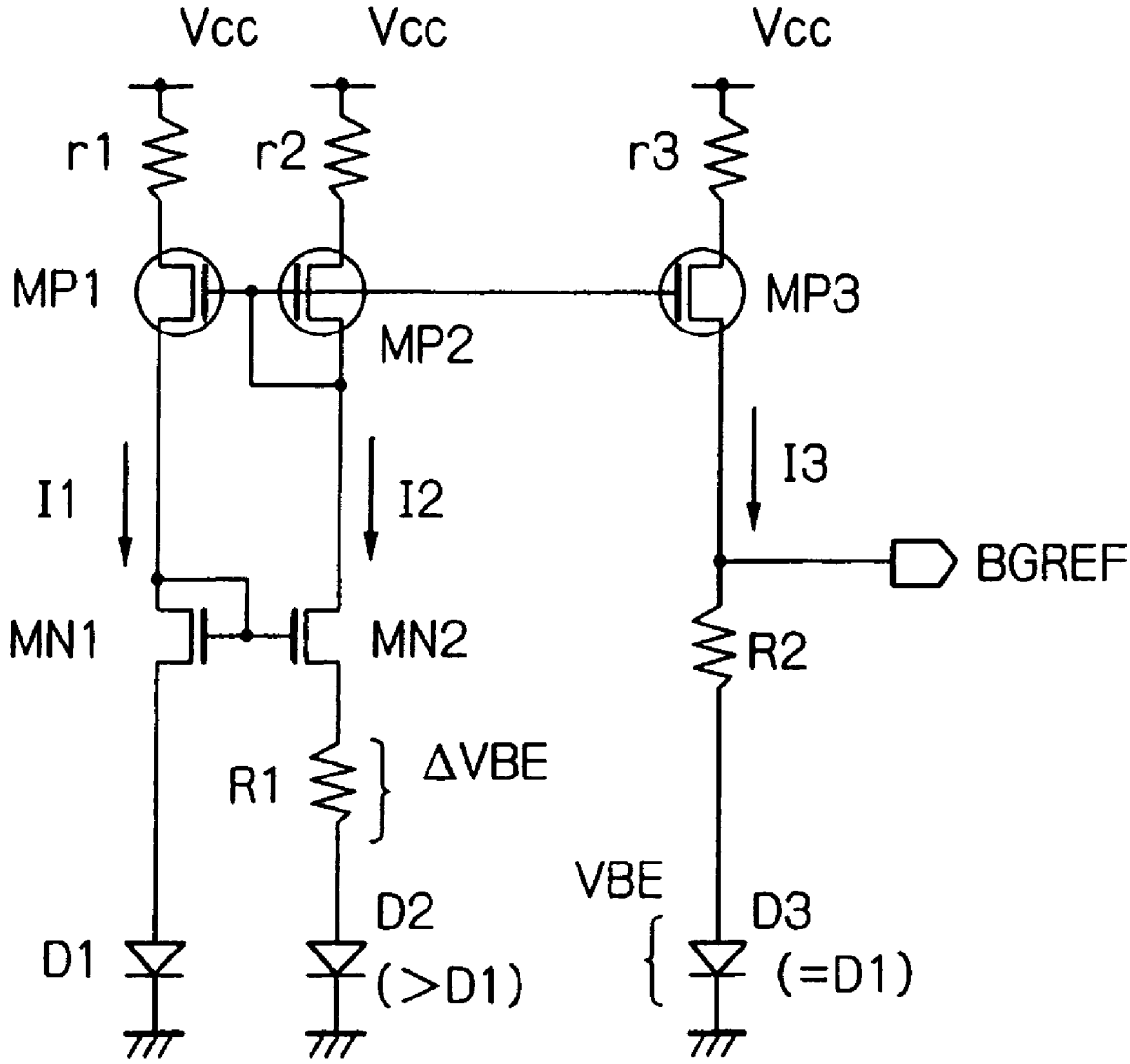
FIG. 3 is a schematic circuit diagram showing a bandgap power supply circuit of the present embodiment.

FIG. 3 is a schematic circuit diagram showing a bandgap power supply circuit of the present embodiment. Referring to FIG. 3, a bandgap power supply circuit of the present embodiment includes transistors MP1 to MP3, transistors MN1 and MN2, diodes D1 to D3, resistances R1 and R2, and resistances r1 to r3.

For calculation simplicity, it is assumed that transistors MP1 to MP3 are PMOS transistors of an identical size, and transistors MN1 and MN2 are NMOS transistors of an identical size. Diodes D1 to D3 are used as an example, but any other devices can be used as long as they have similar I-V characteristics and have the temperature dependence that is characteristic of diodes. For example, bipolar transistors or MOS transistors may be used as diodes D1 to D3. It is assumed that the PN junction area of diode D1 and that of D3 are the same. It is also assumed that diode D2 has a greater PN junction area than diode D1.

Resistance r1, transistor MP1, transistor MN1 and diode D1 are connected in series in this order to power supply Vcc. Similarly, resistance r2, transistor MP2, transistor MN2 resistance R1 and diode D2 are connected in series in this order from power supply Vcc. Further, resistance r3, transistor MP3, resistance R2, diode D3 are connected in series in this order to power supply Vcc. Transistors MP1 to MP3 constitute a current mirror portion. Output voltage BGREF is output from the node between transistor MP3 and resistance R2.

Here, currents flowing through transistors MP1, MP2 and MP3 will be denoted as I1, I2 and I3, respectively. The potential difference between both ends of resistance R1 is referred to as ΔVBE.

Resistances R1 and R2 are set up with appropriate values so that the temperature dependence of BGREF is minimized.

It is also assumed that there is a minute difference (offset) ΔVtp in threshold voltage Vth between transistor MP1 and transistor MP2. It is assumed that this difference produces current error ΔI between current I1 flowing through transistor MP1 and current I2 flowing through transistor MP2. It is also assumed that the S-coefficients of transistors MP1 to MP3 and transistors MN1 and MN2 as MOS transistors are S.

One of the features of the bandgap power supply circuit of the present embodiment is that resistance r1 is interposed between the source of transistor MP1 and power supply Vcc, resistance r2 is interposed between the source of transistor MP2 and power supply Vcc, and resistance r3 is interposed between the source of transistor MP3 and power supply Vcc.

Since there is a minute difference ΔVtp in threshold voltage Vth between transistor MP1 and transistor MP2, the relationship represented by Eq. (17) holds between gate-source voltage Vgs1 of transistor MP1 and gate-source voltage Vgs2 of transistor MP2.

$$Vgs1=Vgs2-\Delta Vtp \tag{17}$$

Further, current I1 flowing through transistor MP1 and current I2 flowing through transistor MP2 are represented by Eq. (18) and Eq. (19), respectively.

$$I1=I0\cdot 10^{((Vgs1-Vtp)/S)} \tag{18}$$

$$I2=I0\cdot 10^{((Vgs2-Vtp-\Delta Vtp)/S)} \tag{19}$$

Accordingly, from Eqs. (17) to (19), Eq. (20) is obtained.

$$I2/I1=10^{((Vgs2-Vgs1-\Delta Vtp)/S)} \tag{20}$$

Eq. (20) is transformed into Eq. (21):

$$\begin{aligned} Vgs2-Vgs1 &= \Delta Vtp+S\cdot\log(I2/I1) \\ &= \Delta Vtp+S\cdot\log(1+(\Delta I/I1)) \\ &= \Delta Vtp+(S/\ln 10)\cdot\ln(1+(\Delta I/I1)) \end{aligned} \tag{21}$$

Using linear approximation (ln(1+x)≅x), $$Vgs2-Vgs1\approx\Delta Vtp+(S/\ln 10)\cdot(\Delta 1/I1) \tag{22}$$

On the other hand, in the present embodiment, resistance r1 and resistance r2 are equal in resistance value. When this resistance value is denoted by R, the following relationship holds:

$$I1\cdot R+Vgs1=I2\cdot R+Vgs2 \tag{23}$$

Because this relationship is transformed by rewriting the difference in current between current I1 and current I2 as ΔI, $$Vgs2-Vgs1=R\cdot(I1-I2)=-R\cdot\Delta I \tag{24}$$

From Eq. (22) and Eq. (24), the relationship between ΔI and R is given as $$-R\cdot\Delta I\approx\Delta Vtp+(S/\ln 10)\cdot(\Delta I/I1) \tag{25}$$

From this, current difference ΔI is approximated by Eq. (26).

$$\Delta I\approx-\Delta Vtp/(R+(S/(\ln 10\cdot I1))) \tag{26}$$

As a specific example, assuming that S=90 mV, current difference ΔI is obtained from Eq. (26) as $$\Delta I\approx-\Delta Vtp/(R+(39\text{ mV}/I1)) \tag{27}$$

Accordingly, as has been described heretofore, according to the power supply circuit of the present embodiment, since a plurality of transistors MP1 to MP3 constituting a current mirror are connected in series with respective resistances r1 to r3 having resistance value R for reducing characteristics variations of the transistors, it is possible to reduce current difference ΔI compared to the case where resistance value R is zero, hence it is possible to reduce the influence on the output voltage due to variation in device characteristics.

Further, since resistances r1 to r3 are individually connected between respective transistors MP1 to MP3 and power supply Vcc, it is possible to reduce the influence on the output voltage due to variation in threshold voltages Vth of the transistors.

As understood from Eq. (26), selection of resistance value R makes it possible to suppress to a low level current difference ΔI corresponding to difference ΔVtp in threshold voltage Vth, hence it is possible to improve the effect of correcting variation in characteristics. Though the output voltage shift due to variation in characteristics is preferably as small as possible, the permissible range of the output voltage or current difference is determined by the conditions required by the circuit configuration to which the power supply circuit is applied. It is possible to efficiently reduce the output voltage shift by selecting a proper resistance value R in order to suppress the influence of the variation in characteristics, which is indexed by current difference ΔI, to and within a predetermined range that is determined in accordance with the required conditions.

It is also said from Eq. (26) that the greater the resistance value R, the more efficiently variation is corrected. However, as resistance value R becomes greater, the voltage drop proportionally becomes greater. As a result, the power supply operating margin of the circuit to which the power supply circuit is applied will be reduced. Since the permissible power supply operating margin differs depending on the individual circuits to which the power supply circuit is applied, resistance value R may and should be set at maximum within the range of the power supply operating margin. With this scheme, it is possible for the power supply circuit of the present embodiment to reduce the influence of variation in characteristics upon the output voltage while producing an output voltage within the power supply operating margin.

As a specific example, assuming that I1=1 μA, ΔVtp=10 mV and R=100 kΩ, current difference ΔI≅0.07 μA (error 7%) is obtained from Eq. (27). Since ΔI≅0.26 μA (error 26%) when no resistances r1 to r3 are used, or when resistance value R=0Ω, it can be said that the current error is reduced from 26% to 7%.

Further, for calculation simplicity here it was assumed that transistors MP1 to MP3, MN1 and MN2 are of an identical size and diodes D1 and D3 are of an identical size. However, in other than the above case it is also possible to similarly reduce the shift of output voltage BGREF by the effect of resistance value R.

(The Difference from Circuits that Use Bipolar Transistors)

Configurations in which resistances are inserted, as described above, have been disclosed as examples of circuits using PNP bipolar transistors, in which, for example, the source node is replaced by the emitter, the drain node is replaced by the collector, and the gate node is replaced by the base (for example, see Japanese Patent Application Laid-open 06-062531 and Japanese Patent Application Laid-open 02-165212).

In the circuit using bipolar transistors, the above configuration is needed in order to improve the current mirror characteristics attributed to the base current that is unique to a bipolar transistor and to improve the circuit characteristics attributed to the voltage dependence that is caused by the Early voltage unique to bipolar transistors. Accordingly, in a circuit using bipolar transistors it is necessary to insert resistance devices without regard to device-to-device variation.

In contrast to this, in a circuit using MOS transistors, no substantial base current that is found in bipolar transistors exists, and the voltage dependence attributed to the Early voltage that is found with bipolar transistors is very small so that usually it does not cause any problem. That is, conventionally, no circuit that uses MOS transistors has had a resistance inserted in order to prevent the voltage operating margin from being lowered.

In the present embodiment, the purpose of the configuration that has resistances inserted into a circuit using MOS transistors, is to address the technical requirement for reducing the change in current through the current mirror as a countermeasures against variation. That is, the basic concept is quite different from that of the configuration with bipolar transistors.

While preferred embodiments of the present invention have been described using specific terms, such description is for illustrative purposes only, and it is to be understood that changes and variations may be made without departing from the spirit or scope of the following claims.

What is claimed is:

1. A power supply circuit for producing a reference voltage, comprising:

a plurality of MOS transistors comprising a current mirror to produce the reference voltage; and a plurality of variation alleviating devices connected in series with the individual transistors, wherein the variation alleviating devices have a resistance value that reduces the influence of the variation in threshold voltages of each of the transistors, wherein when the S-coefficient of the multiple transistors is represented by S, the current value flowing through any one of transistors is I1, the difference in threshold voltage between the transistor and another transistor is $\Delta Vt$, the resistance value of the multiple variation alleviating devices is R, then the resistance value R is selected so that current difference $\Delta I$ that is approximated by $-\Delta Vt/(R+S/(\ln 10 \cdot I1)))$ falls equal to a predetermined value.

2. The power supply circuit according to claim 1, wherein the variation alleviating device is a resistance interposed between each of the transistors and an external power supply.

3. The power supply circuit according to claim 1, wherein the variation alleviating device is a resistance interposed between the source of the transistor and the external power supply.

4. The power supply circuit according to claim 1, wherein the variation alleviating devices reduces the shifts of the reference voltage due to the difference in threshold voltage between the plurality of transistors to and within a predetermined range.

5. The power supply circuit according to claim 1, wherein the variation alleviating devices are resistances having the maximum resistance of the resistance values that enable the reference voltage to be produced within a predetermined margin.

6. The power supply circuit according to claim 1, wherein the variation in threshold voltages of each of the plurality of transistors is due to characteristics variations of each of the transistors made by device-to-device variation.

7. The power supply circuit according to claim 1, wherein the MOS transistors of said plurality of MOS transistors are p-channel MOS transistors.

8. A power supply circuit for producing a reference voltage, comprising:

a plurality of MOS transistors comprising a current mirror to produce the reference voltage; and a variation alleviating device connected in series with at least one of the plurality of MOS transistors, wherein the variation alleviating device has a resistance value that reduces an effect a variation in threshold voltage between said plurality of MOS transistors has on the reference voltage, and wherein each of the variation alleviating devices has a resistance value R that is greater than zero, such that a current difference between a first current I1 flowing through a first MOS transistor among the plurality of MOS transistors and a second current I2 flowing through a second MOS transistor among the plurality of MOS transistors is reduced.

9. The power supply circuit according to claim 8, wherein the current difference is produced by a threshold voltage difference between a first threshold voltage of the first MOS transistor and a second threshold voltage of the second MOS transistor.

* * * * *

UNITED STATES PATENT AND TRADEMARK OFFICE

CERTIFICATE OF CORRECTION

PATENT NO. : 7,633,279 B2
APPLICATION NO. : 11/365668
DATED : December 15, 2009
INVENTOR(S) : Takashi Asaoka et al.

It is certified that error appears in the above-identified patent and that said Letters Patent is hereby corrected as shown below:

Column 3, Line 16, delete "BGREF' = VBE + (R2/R1)·$10^{(-\Delta}$Vp/S·ΔVBE (5')"
and insert -- BGREF' = VBE + (R2/R1)·$10^{(-\Delta p/S)}$·ΔVBE (5') --

Signed and Sealed this

Ninth Day of November, 2010

David J. Kappos

David J. Kappos
*Director of the United States Patent and Trademark Office*